United States Patent [19]

Komori et al.

[11] 4,256,400

[45] Mar. 17, 1981

[54] COPYING MACHINE PROVIDED WITH MEANS FOR SELECTIVELY SETTING ORIGINAL BASE LINE

[75] Inventors: Shigehiro Komori, Yokohama; Hajime Katayama, Kawasaki, both of Japan

[73] Assignee: Canon Kabushiki Kaisha, Tokyo, Japan

[21] Appl. No.: 948,401

[22] Filed: Oct. 4, 1978

[30] Foreign Application Priority Data

Oct. 8, 1977 [JP] Japan ..... 52-121176
Apr. 28, 1978 [JP] Japan ..... 53-51843

[51] Int. Cl.[3] ..... G03G 15/00

[52] U.S. Cl. ..... 355/14 SH; 355/7; 355/71

[58] Field of Search ..... 355/7, 8, 11, 14 R, 355/14 SH, 3 SH, 71

[56] References Cited

U.S. PATENT DOCUMENTS

| | | | |
|---|---|---|---|
| 3,827,799 | 8/1974 | Koizumi | 355/7 X |
| 3,901,593 | 8/1975 | Kogiso et al. | 355/57 X |
| 4,129,378 | 12/1978 | Rattin et al. | 355/7 X |

*Primary Examiner*—R. L. Moses
*Attorney, Agent, or Firm*—Fitzpatrick, Cella, Harper & Scinto

[57] ABSTRACT

A copying machine capable of making a copy of a selected area of a document, which is provided with a mechanism for setting the base line for copying a document placed on the original table as desired and for aligning the edge of copying material with the selected base line. The base line for copying is selectively determined by moving an indicator and when the moving optical system of the copying machine reaches the selected base line, an imagewise exposure is started. In timing with the exposure, feeding of copying material is also started. The lens of the optical system is moved by a distance determined by the distance which the indicator has moved to select the base line and the edge of the copying material is brought in alignment with the base line. To prevent the unnecessary area of the document from being copied, the area of photosensitive medium corresponding to the unnecessary area is exclusively exposed to light so as to erase the electrostatic latent image on this area.

13 Claims, 20 Drawing Figures

COPYING MACHINE PROVIDED WITH MEANS FOR SELECTIVELY SETTING ORIGINAL BASE LINE

BACKGROUND OF THE INVENTION

1. Field of the Invention

The present invention relates to a copying machine in which the original base line defining the area to be copied can be selected as desired for a document placed on the original table.

2. Description of the Prior Art

Copying machine hitherto known in the art includes an original table having a surface on which a document to be copied is placed. The table surface on which an original is placed (hereinafter referred to as original placement surface) is usually a rectangular or cylindrical surface of a size large enough to cover the largest size of original and has an original base line along which a document to be copied should be positioned.

FIG. 1A shows an example of rectangular original placement surface with two opposite long sides extending in X-direction and two opposite short sides extending in Y-direction normal to the X-direction. When a document of format A3 (size: 420×297 m/m) or of format B5 (182×257 m/m) is placed on the surface, the long and short sides of the rectangular original placement surface provide an original base line along which the document to be copied should be placed respectively. In this case, the sides of the rectangular original surface constitute the above mentioned original base line.

FIG. 1B shows another case of original alignment on the rectangular original placement surface. In this case, the center line of a document of format A3 or of format A4 (210×297 m/m) is aligned with the center line Yo of the rectangular original placement surface and one short side of the document is aligned with the corresponding one short side of the original placement surface as shown in FIG. 1B. Therefore, the short side of the rectangle provides an original base line for alignment in X-direction and the center line Yo means a base for alignment in Y-direction.

Herein, the term "original" should be understood to include not only a normal sheet of document or book but also a portion or portions thereof to be copied and a plural number of small size documents placed on the original placement surface at the same time for making copies thereof separately.

In the known copying machine, the above described original base line is located in a fixed position and therefore no change of the position is allowable. Since, as previously noted, a pair of original base lines in X and Y directions define one position in which one original should be placed, only one original which can be placed on the original placement surface for each copying operation.

However, the original placement surface has an area large enough to cover an original of the largest format, for example, format A3. If the size of original to be copied is of a smaller format such as A4, A5 (210×148 m/m) or A6 (148×105 m/m), a plural number of such small size originals can be placed on the original placement surface at the same time. Also, if the original base line for copying could be determined as desired after placing a document on the original placement surface, there would be obtained such possibility that a plural number of areas of one document placed on the original placement surface can be copied separately without the necessity of moving the document every time. This would give a great convenience, for example, for such case where two pages of a bound document or book placed opened on the original placement surface are copied separately.

As will be understood by the above mentioned examples, copying machines could have an additional function very convenient to the users if it were made possible to selectively set the original base line in both of X and Y directions as desired for a plural number of originals placed on the original placement surface at the same time for making copies thereof separately.

Another thing to be noted in connection with the present invention is that the area of the portion of a document to be copied does not always correspond to the size of copy material used at that time and there are often the cases where the area to be copied is smaller than the size of the copy material used. In such case, the copy produced from the original inevitably contains unnecessary image and information of portions other than the area to be copied (such as an image of the cover plate for original), since the image formed on the copy material generally covers whole the size of the material.

To eliminate this inconvenience, it is required to erase the unnecessary information so that the area to be copied may be exclusively copied on the copy material. If the copying machine were provided with means for determining a rectangular area on the copy material corresponding to the area of a document to be copied and preventing any unnecessary image from being formed on the remaining areas other than the determined rectangular area of the copy material, then the requirement could be satisfied and thereby the original processing ability of the copying machine might be further improved.

SUMMARY OF THE INVENTION

Accordingly, it is the primary object of the invention to provide a copying machine which allow one to selectively determine the original base line defining the position in which an original is to be placed.

It is another object of the invention to provide a copying machine in which a plural number of originals are allowed to be placed on the original placement surface at the same time and the plural number of originals can be copied separately from each other.

It is a further object of the invention to provide a copying machine in which an area of a document to be copied is destinated as a copy area and only the copy area is copied exclusively on a copy material.

To attain the objects according to the present invention there is provided a copying machine comprising an original table having a surface on which an original is placed, an optical means including a lens system for projecting the image of the original onto a photosensitive medium, means for visualizing the image on the photosensitive medium, means for determining an original base line for the original on the original placement surface and a control means for controlling the position of image projected on a copy material depending upon the position of the original base line determining means.

Other and further objects, features and advantages of the invention will appear more fully from the following description taken in connection with the accompanying drawings.

DETAILED DESCRIPTION OF PREFERRED EMBODIMENTS

Now, the present invention is described in detail with reference to some embodiments in which the present invention is embodied in a copying machine having a mirror scanning system. While the invention is described in particular in connection with such copying machine having a mirror scanning system, it should be understood that the invention is applicable also to other types of copying machines such as that having a moving original table or a flash type copying machine in which the whole surface exposure is carried out by flash light. Therefore, the term "scanning system" used herein should be understood to include all types of forward and backward moving system used to optically scan the original such as mirror scanning system, moving original table and others.

Figure 1A:
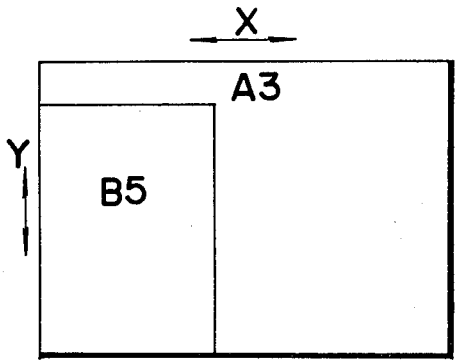
FIGS. 1A and 1B illustrate examples of the base position for original on the original placement surface in the conventional copying machine.
Figure 1B:
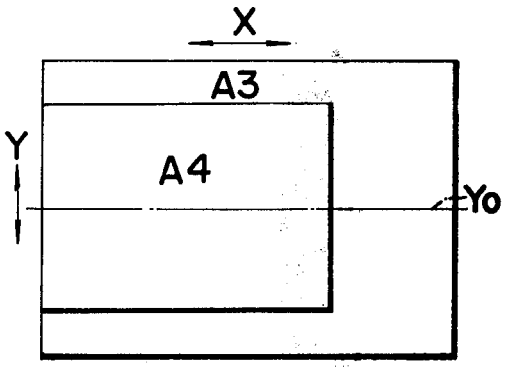
Figure 2:
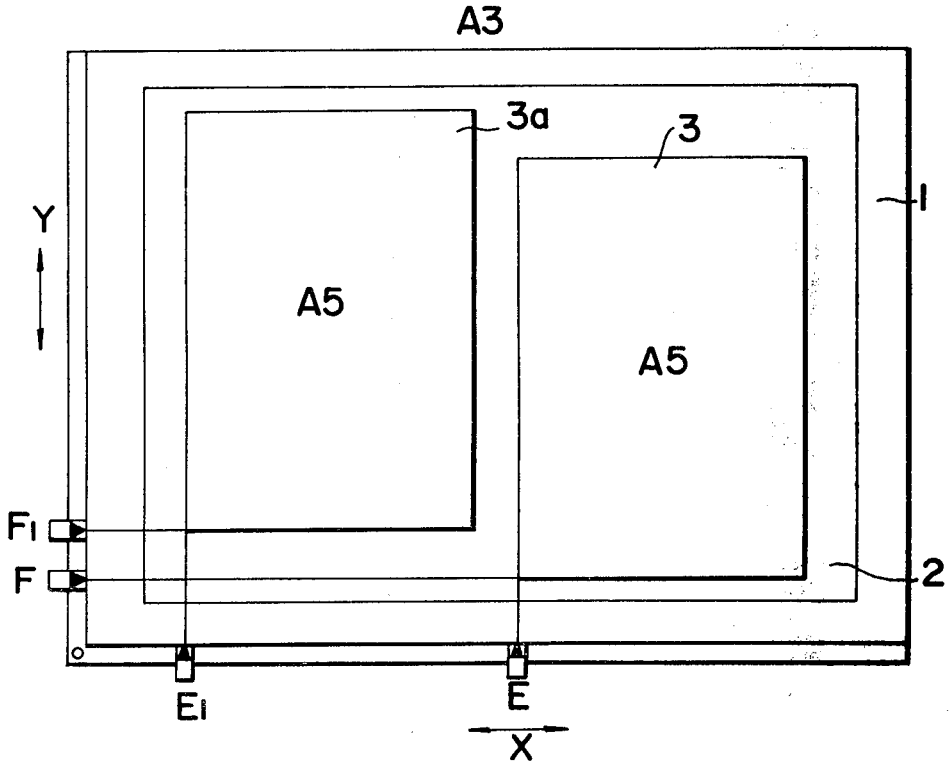
FIG. 2 illustrates examples of the base position for original determined according to the invention.

Referring first to FIG. 2, there is shown an original placement surface 1 the area of which is sufficiently large enough to cover the size of format A3. Designated by 2 is a document placed on the surface 1. The rectangular area 3 of the document 2 is to be copied and has a size nearly equal to format A5. In this case, one indicator is moved to the position E in X-direction and another indicator to the position F in Y-direction to set the original base line for copying the area 3. If another portion of the same document 2 such as area 3*a* is wished to be copied, then another two indicators can be moved to the positions $E_1$ and $F_1$ in X and Y directions respectively so as to set the original base line for copying the area 3*a*. A desired number of these indicators may be provided movably in X and Y directions.

In this manner, according to the invention, when a document is placed on the original placement surface, it is no longer necessary to exactly align the document with the original base line. The original base line can be set afterwards as desired for the document placed on the surface for copying. Moreover, two or more original base positions can be determined for different originals placed on the original placement surface. Therefore, as seen in FIG. 2, it is allowed to separately copy two or more areas of one and same document or to separately copy two or more different documents placed on the original placement surface together. This makes the copying operation very convenient to the users of the copying machine. As to the method for setting the original base line and the method for making copies of the original defined by the original base line, a further description will be made hereinafter in detail.

Figure 3A:
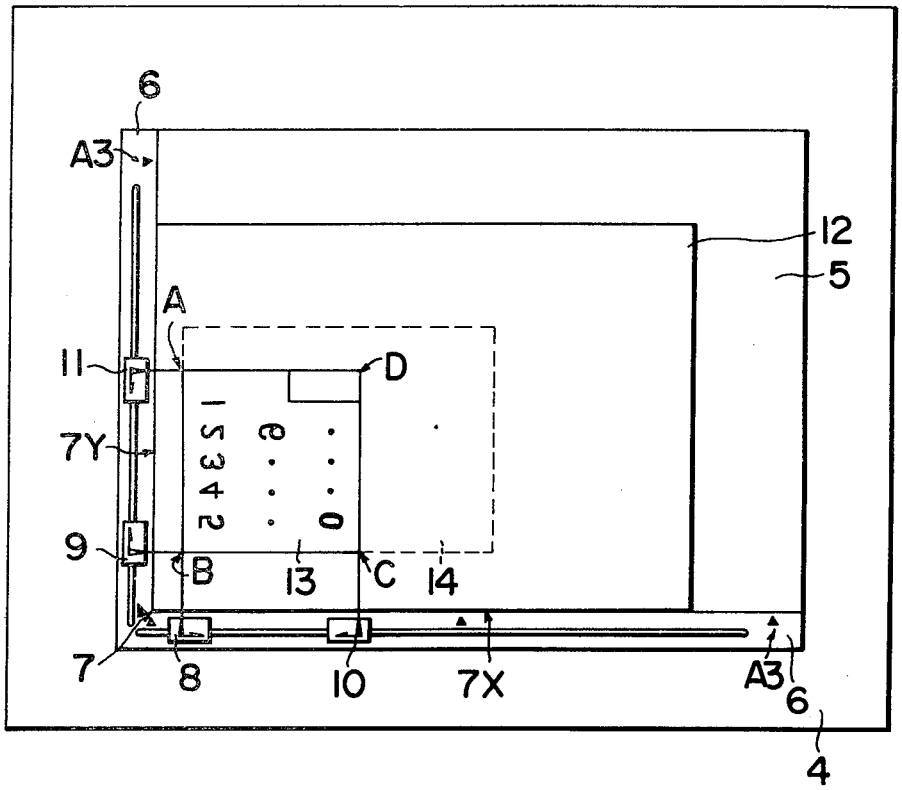
FIGS. 3A and 3B illustrate examples of the copy area defined according to the invention.
Figure 3B:
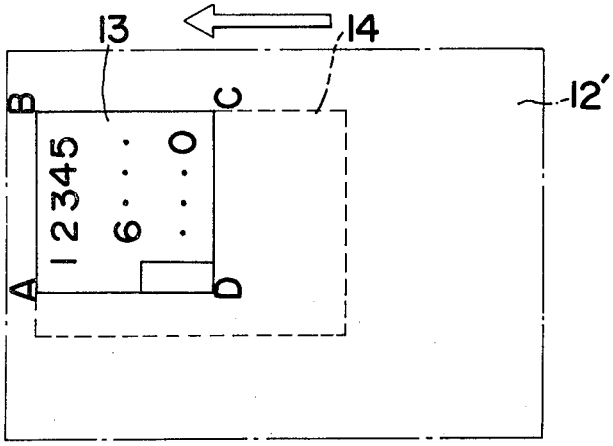

FIGS. 3A and 3B illustrate the copy areas determined in accordance with the invention.

In FIG. 3A, numeral 4 designates an original table including an original placement surface 5 which is usually formed by a transparent plate and an indication plate 6 for indicating the position in which an original should be positioned. In the shown embodiment, the area of the original placement surface 5 is large enough to cover an original of format A3 positioned along the base lines 7X and 7Y which intersect at the base point 7. Slide movably mounted on the indication plate 6 are two original base line indicators, that is, X-indicator 8 and Y-indicator 9 and two range indicators, that is, XR-indicator 10 and YR-indicator 11. Numeral 12 designates a document placed on the original placement surface 5 and numeral 14 suggests a copy material. Assuming that the hatched portion of the document 12 is to be copied, the base line indicators 8 and 9 and the range indicators 10 and 11 are moved to define a copy area 13 in which the hatched portion of the document 12 is contained. As shown in FIG. 3A, the copy area 13 of a rectangle ABCD defined by the four indicators well covers the hatched portion of an irregular form containing the necessary information 1, 2, 3 . . . 0 to be copied. By setting the copy area 13 in this manner, only the area of the document corresponding to the copy area 13 of the rectangle ABCD can be copied on the copy material 14 while erasing the image present outside the copy area 13. FIG. 3B shows one copy of the document 12 obtained in this manner. Numeral 12′ indicates the area in which image is present and corresponds to the document 12. Hereinafter, such area as indicated by 12′ is referred to as original image.

Figure 4:
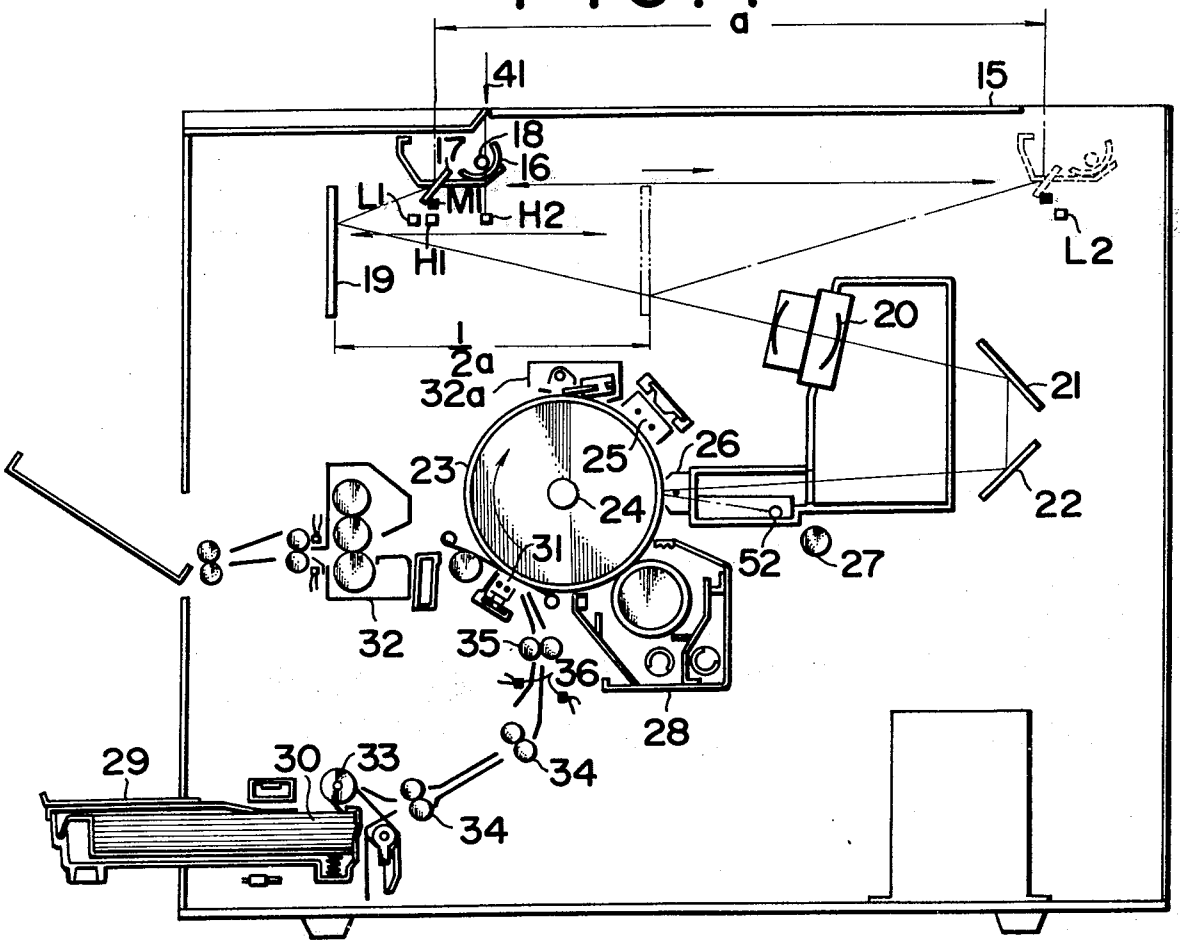
FIG. 4 is a sectional view of a copying machine to which the present invention is suitably applicable.

The present invention is advantageously applicable to a copying machine of the type shown in FIG. 4.

In FIG. 4, an original is placed on the original placement surface 15 and scanned using an illumination system comprising a reflector 16, first mirror 17 and an illumination lamp 18 and a scanning system comprising a second mirror 19. The illumination system and scanning system are moved under and in parallel with the original placement surface in a manner known per se. The moving direction of the scanning system is the same as that of the illumination system and the moving speed of the former is a half of the moving speed of the latter. The image on the original is imaged on the photosensitive drum 23 through a lens 20 and two stationary mirrors 21 and 22. The photosensitive drum 23 rotates about a shaft 24 fixed to the body of machine in the direction indicated by arrow. During the rotation, the photosensitive drum is subjected to a primary charging by a charging device 25 and thereafter subjected to AC discharging by a discharging device 26 (or to secondary charging with the opposite polarity to that of the primary charging) while being subjected to a simultaneous original imagewise exposure. After that, the drum is irradiated by light from a whole surface exposure lamp 27 to form a latent image of high contrast on the drum. The latent image thus formed is developed with a developing device 28 and then transferred, using a transfer charging device 31, onto a copy material 30 fed from a cassette 29. After being separated from the photosensitive drum 23, the copy material 30 is transported to a fixing device 32 to fix the toner image on the copy material with heat under pressure. After fixing, the copy sheet is discharged from the copying machine. On the other hand, after transferring, the photosensitive drum 23 enters a cleaning station in which residual toner image is removed by a cleaning device 32*a* so that the photosensitive drum becomes ready for the next cycle of copying operation. In FIG. 4, numeral 33 designates a copy paper feeding roller, 34 is a transportation roller for copy paper, 35 is a register roller and 36 is a sensor for detecting the arrival of the copy material.

For the purpose of a better understanding of the invention, now the operational relation between the optical scanning system and the copy material feeding mechanism will be described in detail.

Figure 5:
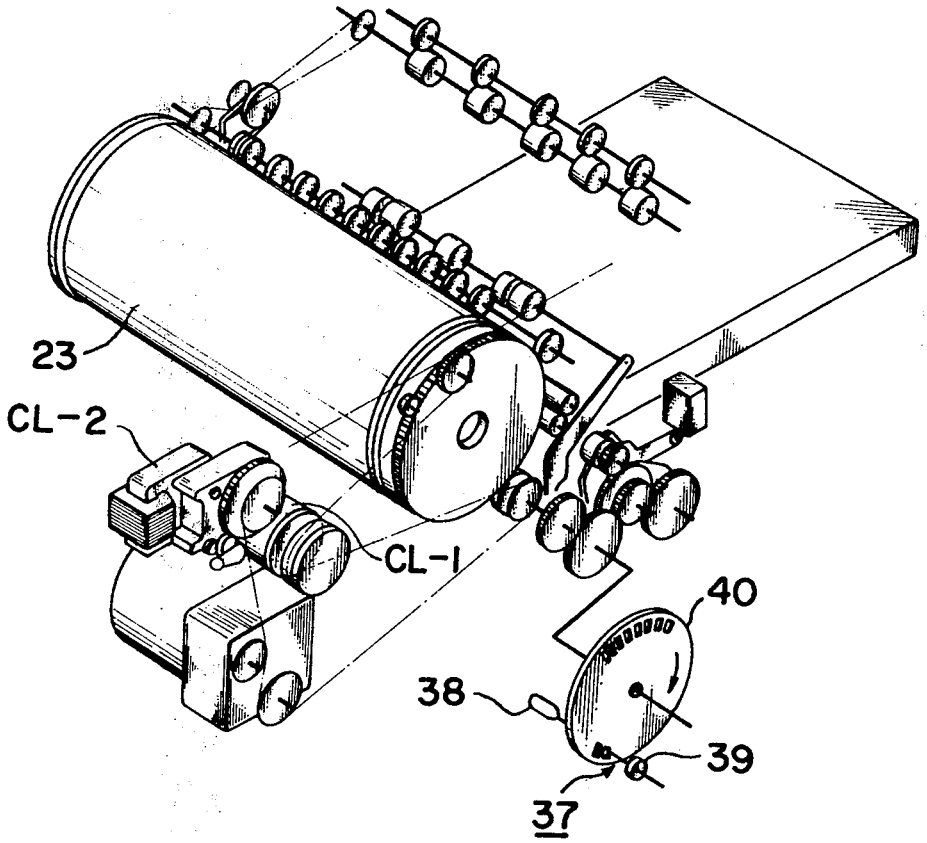
FIG. 5 is a perspective view of a portion thereof showing the relation between the scanning system and the copy material feeding mechanism.

As seen in FIG. 5, the copying machine according to the invention includes a clock pulse generating apparatus 37 operatively connected with the photosensitive drum 23 through a gear train. The clock pulse generator 37 is composed of a lamp 38, a photoelectric element 39 (or a combination of hole IC and magnet) and a rotary disk 40. By counting the number of pulses generated from the pulse generator 37, various controls are carried out. In the moving path of the scanning system there are provided a detector H1 for detecting the home position of the scanning system and a detector H2 for detecting the start of scanning as shown in FIG. 4. For each the detector, for example, a hole IC is used and on the side of the scanning system there is fixed a magnet M1 as an actuating member for the detector. In the starting position of the apparatus shown in FIG. 4, the magnet M1 of the scanning system is opposed to the home position detector H1. When a print button is pushd down in this position, the drum 23 is driven into rotation and also at the same time the clock pulse generating apparatus 37 and a pulse counter (not shown) are brought into operation. A copy sheet feeding signal is produced just after a predetermined number of pulses have been counted. In reply to the signal, the pick-up roller 33 is driven to feed a copy sheet 30 from the cassette 29. The copy sheet 30 reaches the register roller 35 through the transporting roller 34. Immediately before the arrival of the copy sheet 30, the register roller 35 is stopped rotating by a signal coming from the sensor 36. As a result, the copy sheet is stopped with its fore edge abutting against the register roller and forming a slight loop.

On the side of the scanning system, the illumination lamp 18 is put on also after a predetermined number of pulses have been counted. At the same time, a foward movement clutch CL-1 shown in FIG. 5 is turned on to start the forward movement of the scanning system for an imagewise exposure of the original on the original table.

The synchronism of the image formed on the photosensitive drum with the copy sheet arrived at the transferring station is attained in the following manner.

The position at which the fore edge of the original is scanned by the scanning system is indicated by the arrow 41 in FIG. 4. In this position, there is provided the above mentioned detector H2. When the scanning system passes over the position 41, the detector produces a signal which corresponds to the fore edge of the image formed on the photosensitive drum. The clock pulse counter counts those clock pulses generated after the issuance of the above signal during the rotation of the drum. Upon the time when the fore edge of the image on the drum reaches the position at which there is still left for a further movement of the drum a distance corresponding to the distance from the transfer position to the register roller 35, a register actuating signal is produced. In response to the signal, the register roller 35 starts again feeding the copy sheet so as to make a synchronism of the copy sheet with the image on the photosensitive drum. Thereafter, transferring of the image is effected.

For scanning system, it is desirable that the scanning distance be suitably controlled according as the size of original or of copy sheet then used. For this purpose, different pulse numbers are preset for different sizes of copy sheet so that the scanning system may be reversed from forward movement to backward movement when a certain number of pulses preset for the copy sheet then used have been counted starting from the time point when the scanning system passed over the position of the fore edge detector H2. At the end of the backward movement, the scanning system is stopped by the home position detector H1 which detects the arrival of the scanning system at the home position.

Now, a detailed description will be made as to the essential part for the present invention embodied in the above described copying machine.

Figure 6:
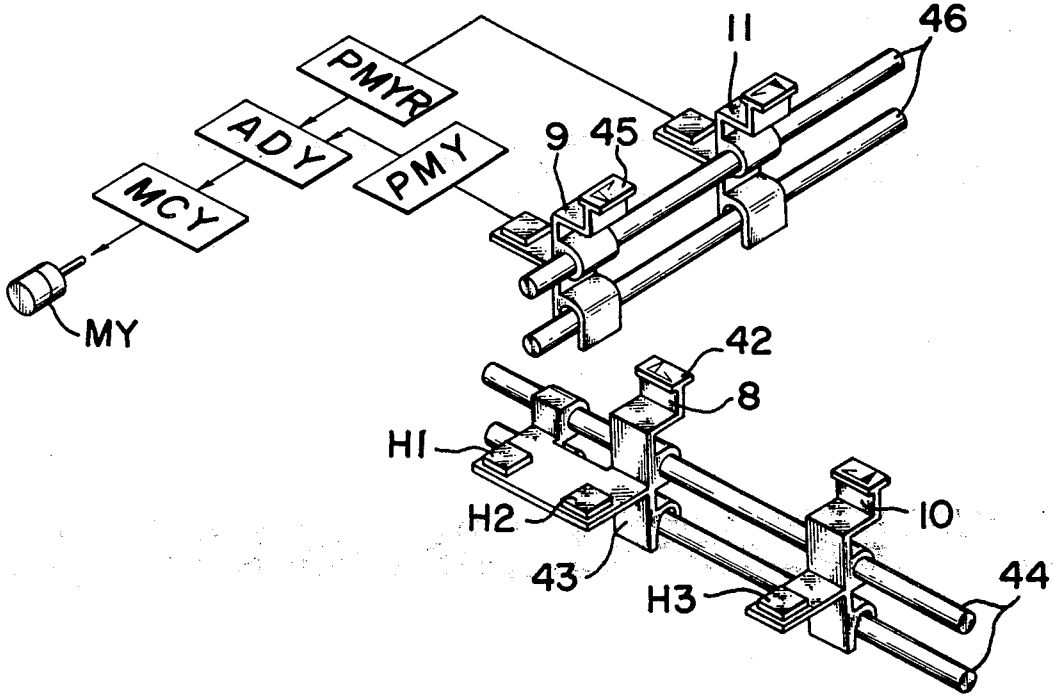
FIG. 6 shows the base line indicator and the copy area indicator of the copying machine.

Within the original table 4 shown in FIG. 3A there is provided fixedly guide means on which the above described base line indicators and copy range indicators are slide movably mounted as shown in FIG. 6.

As already mentioned, X-indicator 8 (which corresponds to the indicator located in position E in FIG. 2) sets a base line in X-direction for the copy range 13. In case of FIG. 3, the base line is line A–B. To correctly define the image position on the copy material 14, the fore edge of the copy material has to be aligned with the line A–B. This means that the timing of actuation of the register roller by the scanning system should be controlled suitably by the slide movement of the X-indicator 8. As seen best in FIG. 6, the X-indicator 8 comprises a mark portion 42 serving also as a knob and a holder portion 43 carrying a home position detector H1 and a fore edge detector H2 and is slide movably mounted on a rail 44 serving as a guide means.

Assuming that in the previous copying operation, the X-indicator 8 was positioned at the base point 7 (FIG. 3A) which is the normal original position, the scanning system is in its home position.

Figure 7:
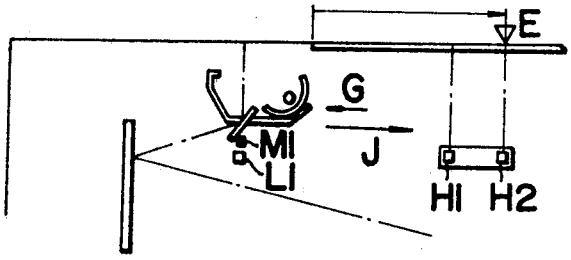
FIGS. 7 and 8 show the positional relation between the scanning system and the detector.
Figure 8:
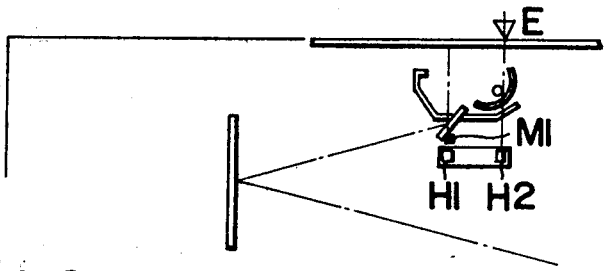

For copying operation to be carried out this time, the X-indicator is now moved to the position shown in FIG. 3A to set a new original base line, that is, line A–B. When copying operation is started and the necessary pre-treatment step is initiated, the backward movement clutch motor CL-2 (FIG. 5) is brought into operation to move the scanning system a short distance in the direction of G as shown in FIG. 7 since the home position detector H1 has been moved together with the X-indicator. The movement of the scanning system in the direction G is limited by a limiter L1 provided in a fixed position somewhat distant from the normal home position. By this limiter L1, the forward movement clutch CL-1 is actuated to move the scanning system now in the direction of J. During this movement of the scanning system with a magnet M1 in the direction J, the magnet M1 comes in the area of the home position detector H1 carried by the X-indicator and actuates the detector. The detector produces a signal to stop the scanning system in the position shown in FIG. 8.

When the pre-treatment step has been completed, a signal is issued from the control apparatus to actuate the clutch CL-1 and also put the illumination lamp on. Thus, the scanning system is moved forward to start scanning of the original. As previously noted, the scanning distance of the scanning system is controlled by counting the number of pulses preset for the size of copy material or cassette then used. For the purpose of safety, there is also provided a limiter L2 (FIG. 4) at the position corresponding to the right side end of the maximum scanning distance. The limiter operates independently of the size of copy material or cassette then used and serves to turn the forward movement clutch motor CL-1 off and the backward movement clutch motor CL-2 on.

As previously described, a copy material is fed from a certain cassette in synchronism with the above described copy cycle or, if necessary, prior to it, and the copy material stops when it reaches the register roller. The register roller is driven only when the above mentioned predetermined number of clock pulses have been counted starting from the original fore edge detection signal issued by the movement of the scanning system. Therefore, a precise coincidence of the fore edge of image with the copy material can be attained. Furthermore, since, as previously noted, the distance of scanning is controlled depending upon the size of the copy material or cassette, the length of copy measured in the direction of scanning is directly determined by the size of the copy material then used. If the distance from the base line set by the X-indicator to the end of the original (that is the length of area really copied) is shorter than the length of the copy material then used, scanning will be terminated when the scanning system actuates the above mentioned limiter L2. In this case, after copying, the copy sheet has a portion remained blank at its rear part. But, there is no trouble for copying.

Figure 9:
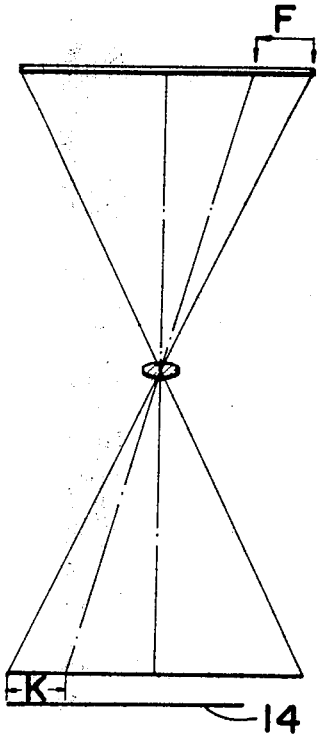
FIGS. 9 and 10 show the positional relation between the original image and the transferred image.
Figure 10:
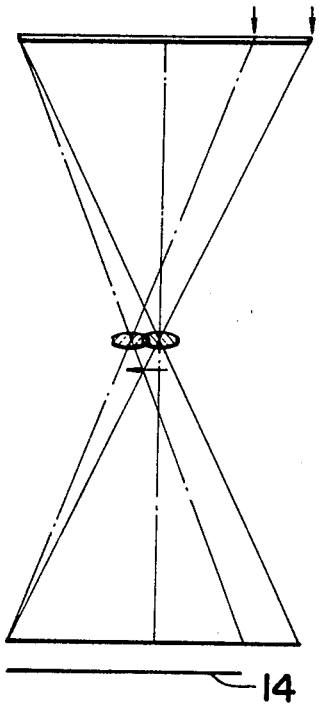

As for Y-direction, Y-indicator 9 is used to set an original base line. As seen best in FIG. 6, like the above described X-indicator, the Y-indicator 9 (which corresponds to the indicator positioned in position F in FIG. 2) comprises a mark portion 45 serving also as a knob and is slide movably mounted on a guide 46. By moving the Y-indicator in the direction normal to the scanning direction, the boundary line at the one side of copy area is determined in said direction. Another boundary line at the opposite side is determined by the size of copy material then used. Thus, an original base line in Y-direction is preset. However, if the indicator is moved to shift the original base line to the position F, the image on the photosensitive medium to be transferred to the copy material 14 will remain offset to the copy material as illustrated in FIG. 9. Since the feeding position (feeding passage) for copy material is fixed, the image to be transferred must be shifted by a distance corresponding to the distance K which the base line has moved relative to the copy material. Otherwise, a portion of the image may be cut off at the time of transferring. Therefore, when the Y-indicator is moved, it is required to move also the lens a certain distance in the same direction as illustrated in FIG. 10. For unit magnification copying, the distance which the lens should be moved in the same direction is $\frac{1}{2}$ of the distance moved by the base line. As a matter of course, in case of the apparatus provided with a variable magnification mechanism, this distance varies depending upon the value of magnification or minification then used.

Figure 11:
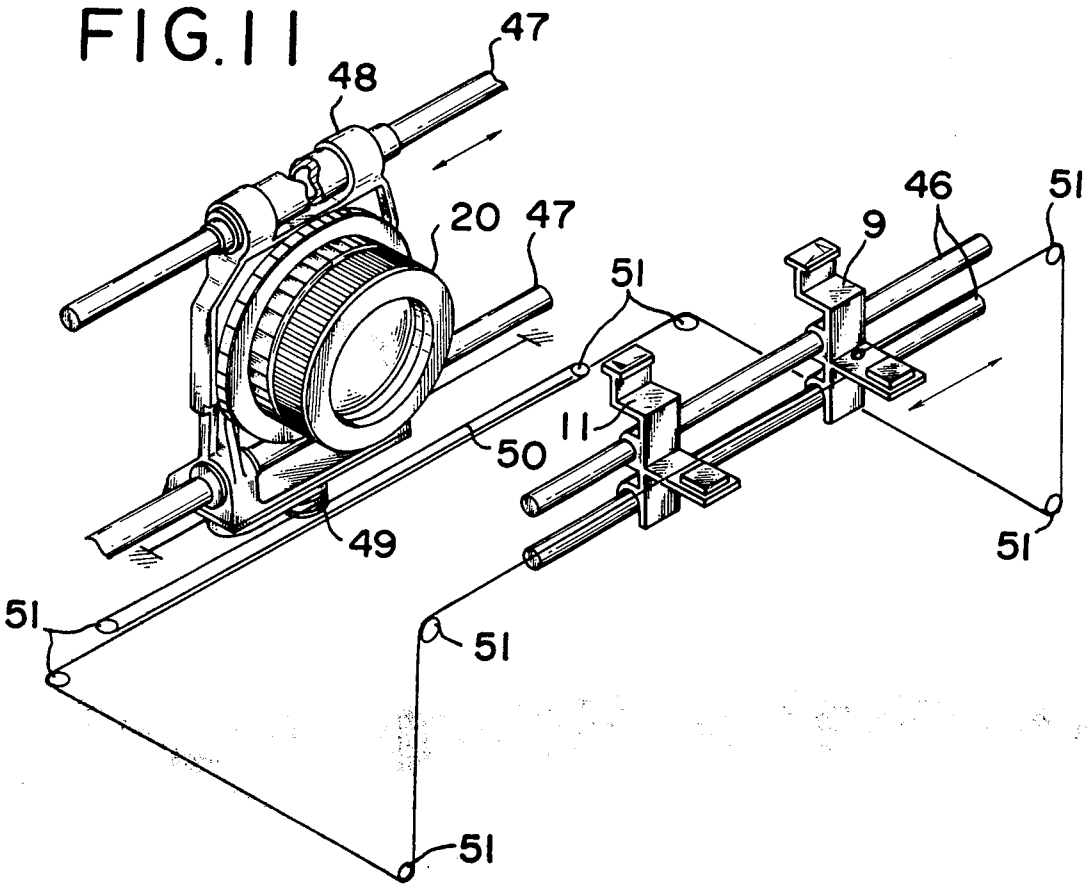
FIG. 11 is a perspective of the lens and the indicator interlocked with each other.

FIG. 11 shows an embodiment of the apparatus used for shifting the lens in Y-direction.

Designated by 47 is a rail fixed to one end wall of a box containing the optical system so as to extend in the direction normal to the optical axis. A lens holder 48 is slide movably mounted on the rail 47. The lens shoulder 48 has a pulley 49 pivotally supported on it. A wire 50 with its both ends fixed to the optical system containing box passes around the pulley 49 and is fixedly connected with the Y-indicator 9 after passing around a number of deflecting pulleys fixed to the body of the apparatus.

As will be understood from FIG. 11, the pulley 49 functions as a running block and therefore when the Y-indicator 9 is moved in the direction indicated by the arrow, the lens 20 moves together with the lens holder 48 in the same direction but by a distance equal to $\frac{1}{2}$ of the distance the indicator is moved.

The method and apparatus for setting an original base line and producing a copy of the area defined by the base line have been described. An original can be placed randomly on the original placement surface and by moving the indicators an original base line can be set as desired for the original placed on the surface. The area of the two side boundaries of which are determined by the base line is copied exclusively. If two or more portions of one and the same document are desired to be copied separately as shown in FIG. 2, at first an exposure is carried out for the area 3 determined by the indicator at E and the indicator at F and then, after returning the scanning system to its starting position, another exposure is carried out for the copy area 3*a* determined by the indicator at $E_1$ and the indicator at $F_1$. In this manner, the desired copies of the areas of the same document can obtained on separate sheets of copy material. The control part for the scanning system may be designed also in such manner that at first an exposure is carried out for the copy area 3*a* and after the exposure the scanning system is stopped at the position where the home position detector H1 of the indicator at E is actuated by the scanning system, and after that, scanning is again started to carry out copying the copy area 3.

While description has been made in connection with a copy machine of the type in which the original table is fixed stationarily and which includes a mirror scanning system, the present invention is also applicable to another type of copy machine. For example, by shifting the home position (starting position) of the original table using the X-indicator, the present invention can be easily embodied in the original table moving type of copy machine. In case that the present invention is applied to the flash exposure type of copying machine, the object of the invention can be attained by moving the lens in a manner as described above in connection with setting of Y direction base line.

In any case, it is only required to shift the position of the lens in a manner as in the case of the shown embodiment, as for Y-indicator. Further, the present invention is applicable to such type of copying machine in which photosensitive paper is used.

Now, a method for erasing the unnecessary image existing in the area outside the copy area will be described with reference to a preferred embodiment thereof.

In apparatus for forming an image according to the electrophotographic method, there is usually used, as image carrier, a photosensitive medium having a photoconductive layer. Such image carrier is subjected to voltage applying step such as charging-discharging by corona discharger or the like and to light irradiation step with light information and the like to form an electrostatic latent image on the image carrier. The electrostatic latent image is developed with developing agent. For dry developing system, powder developer of 5–15μ particle size is used. For wet developing system, the latent image is developed with a developer in a form of particles dispersed in a liquid carrier. The developed image on the image carrier is transferred onto a copy material which may be a sheet of paper, while applying a voltage to the copy material using a discharger or a roller electrode. After transferring, the copy sheet having thereon the transferred image is forcedly separated from the image carrier and the image is fixed on the copy sheet using a heating means such as heat roller or heater. In case that the copy machine is of the type in which electrophotographic process so-called latent image transferring system (TESI) is used, the latent image formed on the image carrier is transferred onto a copy material capable of retaining electric charge and after transferring the copy material having the latent image transferred thereon is separated from the image carrier. After that, developing and fixing are carried out.

In order to erase the unnecessary image existing outside the copy area as shown in FIGS. 3A and 3B according to the invention, control light is irradiated onto the photosensitive medium simultaneously with imagewise exposure or before or after the imagewise exposure so as to control the electrostatic latent image formed on the photosensitive medium. During the irradiation of control light, a masking member the width of which is variable is used for the area to be copied. The masking member cuts off the irradiated control light so that the area covered by the masking member can continue to have the latent image on the photosensitive medium and in the remaining area of the photosensitive medium, the latent image is erased by the control light. In this manner, an image of the copy area selected from a document placed on the original table can be formed exclusively.

Figure 12:
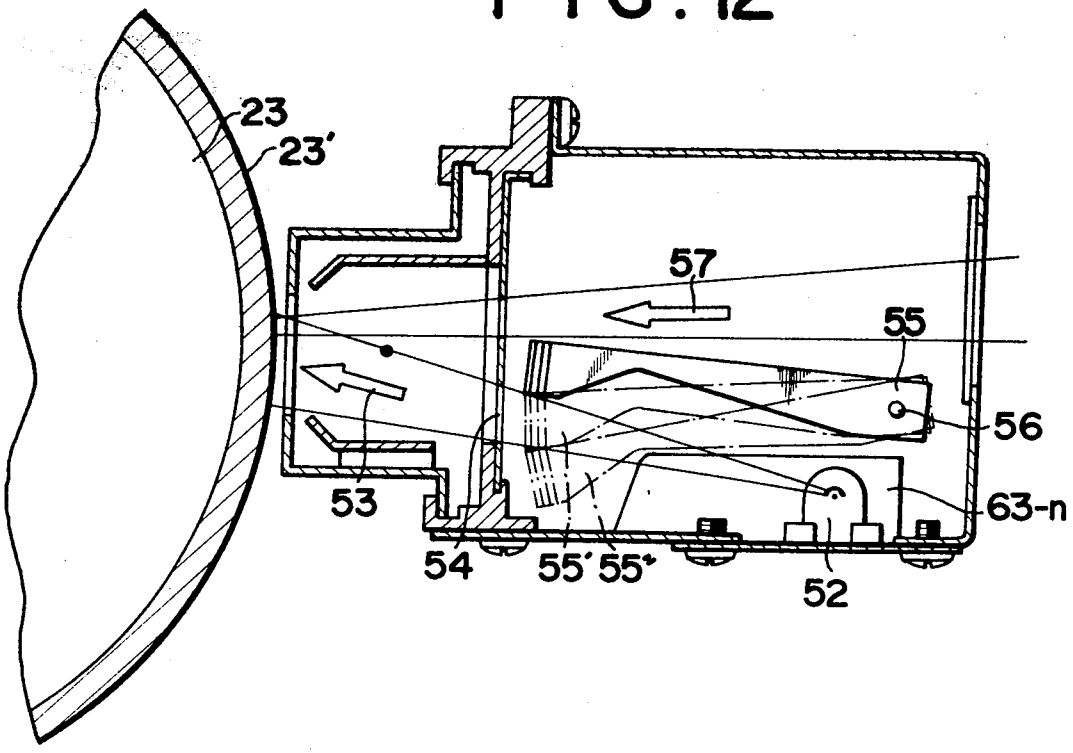
FIG. 12 shows the control mechanism for controlling the formation of electrostatic latent image on the photosensitive medium according to the invention.

Referring now to FIG. 12, the masking member and the use of it for controlling the image area are described. The part shown in FIG. 12 corresponds to the image exposure part shown in FIG. 4.

In FIG. 12, numeral 52 designates a light source for controlling the image area. The light source 52 is composed of a sufficient number of spot light sources enough to irradiate uniformly the whole width area of the photosensitive medium 23' on the drum 23 or of a linear light source of a sufficient width enough to irradiate the whole width area of the photosensitive medium 23'. The light source 52 emits light 53 to control the electrostatic latent image formed on the photosensitive medium and, therefore, to control the image area. The control light 53 passes through a slit 54 by which the light is controlled with respect to the quantity of light and the irradiation area. Electric charge in the unnecessary latent image area on the photosensitive medium 23' is erased by the irradiation of the control light.

Designated by 55 is a masking member having a predetermined width to control the control light 52. The masking member 55 is rotatably supported by a pivot 56 and is movable to the position 55' or 55'' suggested by the phantom line. Numeral 57 designates an original exposure light.

Figure 13:
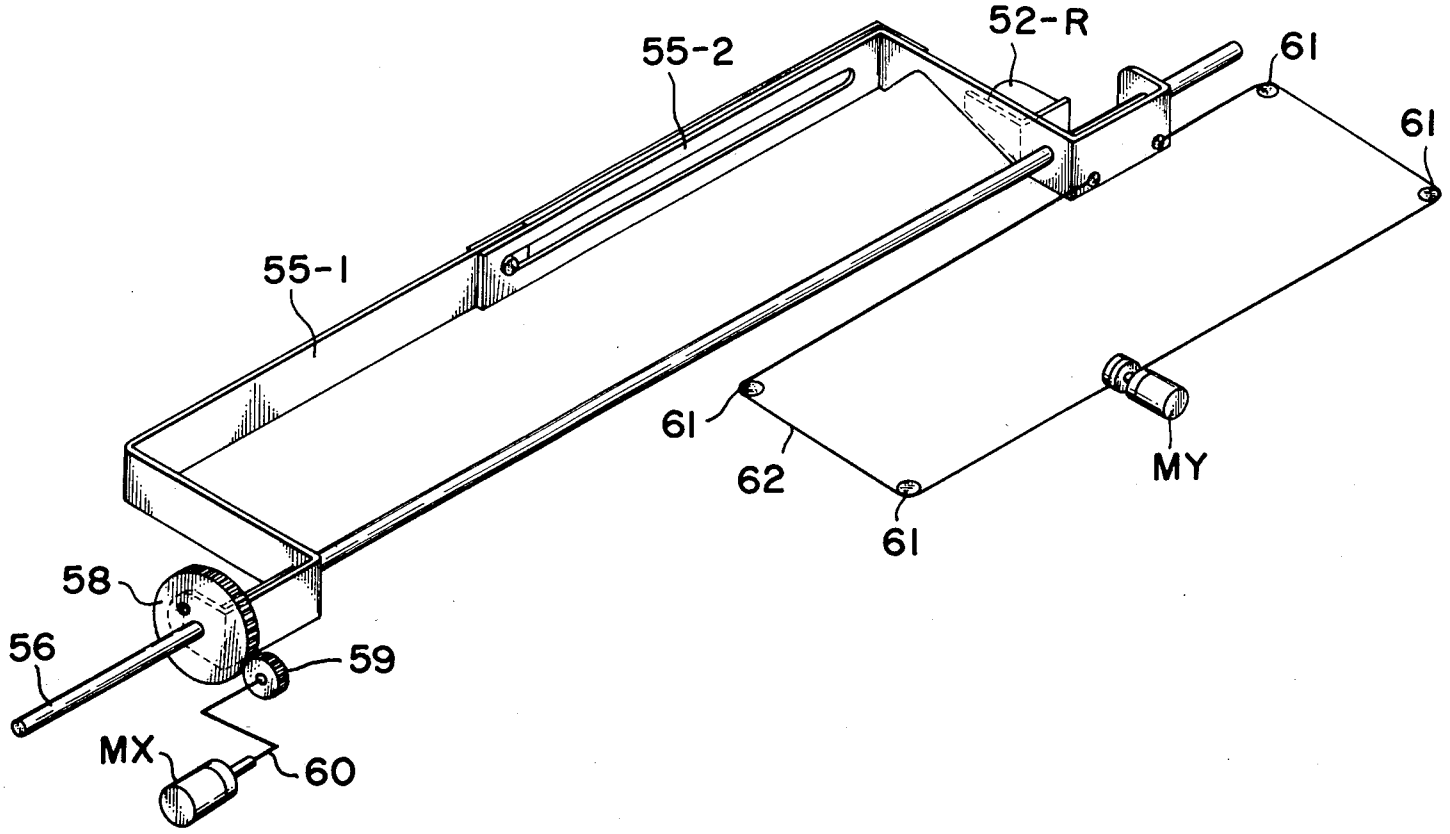
FIG. 13 shows means for controlling the masking member used in the invention.

The position of the masking member 55 is controlled by a control means shown in FIG. 13. The rotation of the masking member about the pivot 56 is controlled by a motor MX through a transmission system 60 and gears 58 and 59 connected to the masking member 55. To make adjustable the width of the masking member 55, it is composed of two elements, a mask element 55-1 and a mask element 55-2. The mask element 55-2 is movable relative to the mask element 55-1. The movement of the mask element 55-2 relative to the element 55-1 is caused by a pulse motor MY through a pulley 61 and a wire 62.

Figure 14:
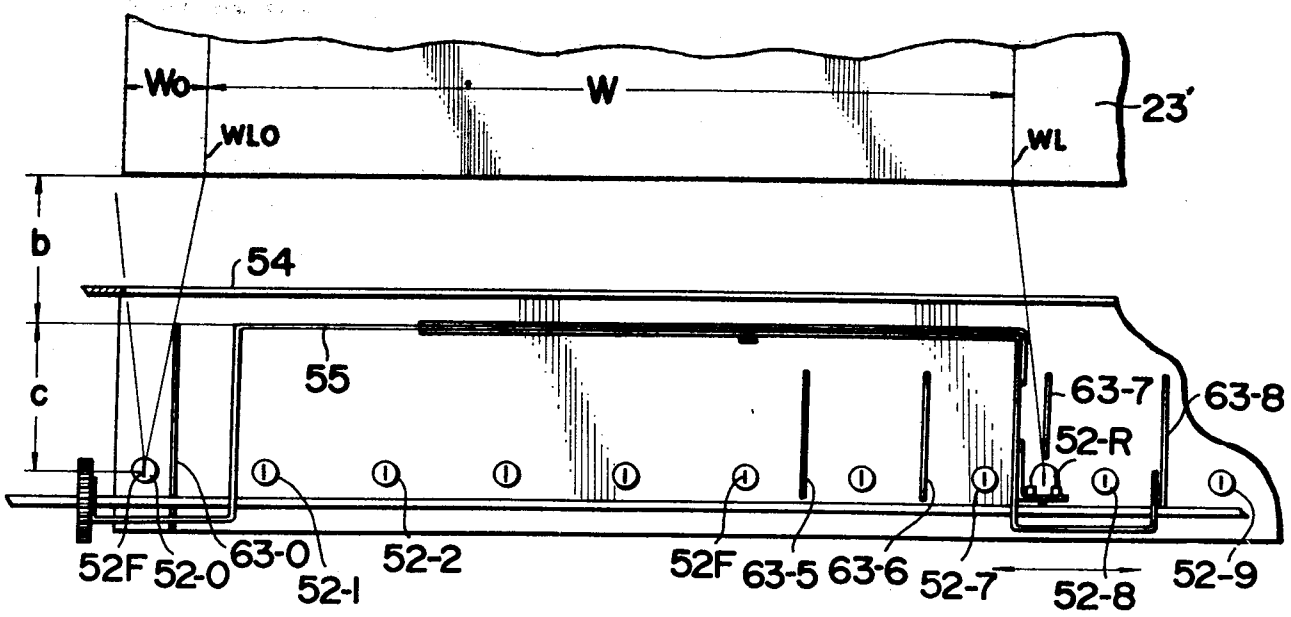
FIG. 14 shows the manner of cutting off the light by the control means.

FIG. 14 illustrates the manner how to mask the light source 52 for the control light 53 by the masking member.

In FIG. 14, the width W corresponds to the length of a copy area measured in Y direction. In the shown embodiment, the light source 52 is composed of a number of lamps, 52-O, 52-n (n=1,2, . . . ), 52-R. Lamp 52-O is provided with a screen plate 63-O to prevent the light of the lamp from interferring with other lamps. Since the lamp 52-O is not under the control of the masking member 55, the light emitted from it always forms an irradiation area of width Wo on the photosensitive medium 23'. Therefore, no latent image is formed in the area of width Wo on the photosensitive medium and the area always remains blank. If the boundary line WLO between the two widths W and Wo is mechanically arranged as to correspond the baselline 7X shown in FIG. 3A, then the edge line of the original image 12' (FIG. 3B) will coincide with the boundary line WLO. When it is desired for an edge portion of the image area 12' to be omitted from the copy thereof, the edge portion aligned with the base line 7X may be positioned in the area of width Wo. By doing so, the image of the portion contained in the area of width Wo will be omitted from the document image area 12' and the portion will remain blank on the copy.

Lamps 52-1 to **52-*n* are under the control of the masking member 55. Between each two lamps of this group there is provided each one screen plate 63-*n* to reduce the interference with each other. Lights emitted from this group of lamps masked by the masking member 55 together form a copy area 13 (see FIG. 3) of width W. When the width W is located in the position shown in FIG. 14**, the boundary line WLO or WL may be made clear, that is, the edge of the image portion may be made sharp by satisfying the following condition:

$$B/c \leqq 1$$

wherein b is distance from the masking member 55 or the tip of the screen plate 63-O to the photosensitive medium 23', and c is distance from the masking member or the tip of the screen plate to the filament 52F of the lamp 52.

To obtain a sharp and clear boundary line WL, it is additionally required to put the lamp 52-8 off and instead to put the lamp 52-R on. The lamp 52-R is movable together with the masking member element 55-2. For the shown embodiment, it has been found that $b \approx c \approx 40$ mm to 50 mm can give a good result. Also, it has been found that a sharp boundary line can be obtained when the lamp 52-0 is positioned as close as possible to the screen plate 63-0. To obtain a sharp and clear boundary line, it is preferable to use a lamp having spot light source. When linear or filament light source is used, it is desirable that the lamp 52-O or 52-R be positioned with its filament 52F being normal to the surface of the photosensitive medium 23'. A good result may be obtained also by carrying out the irradiation through a lens.

In the above described embodiment, the present invention has been applied to the copying machine in which an electrostatic latent image is formed on a photosensitive medium comprising three layers, that is, an electrically conductive layer, a photoconductive layer and an insulating top layer as disclosed in U.S. Pat. No. 3,666,363. The process for forming an electrostatic latent image comprises the steps of primary charging, discharging or secondary charging of the opposite polarity to that of the primary charging with simultaneous imagewise exposure and whole surface exposure. However, the type of copying machine to which the present invention is applicable is by no means limited only to such one. The present invention is applicable also to other various types of copying machines such as Carlson's system in which a latent image is formed by the steps of charging and image projecting. In case of a copying machine according to Carlson's process, the present invention may be realized by providing an additional light irradiation means after charging station or at the step between the charging station and developing station during which an electrostatic latent image is formed. Also, the light irradiation according to the invention may be carried out prior to the charging step if the characteristics of the photosensitive medium then used are suitable for it.

When the present invention is applied to the above described type of copying machine adapted for the electrophotographic method disclosed in the above mentioned U.S. Pat. No. 3,666,363, there is a possibility of producing a copy entirely different from that previously described. More particularly, it is possible to make a copy in which the copy area 13 enclosed by a rectangle ABCD shown in FIG. 3A remains blank (image of the rectangular area 13 is erased) and image of area other than the area 13 is copied. In order to produce such inverted copy, a whole surface exposure lamp is used as the light source for control light and the light emitted from the whole surface exposure lamp is screened by the above described masking member since according to the above described electrophotographic method, an electrostatic latent image of high contrast is formed only in the area of a photosensitive medium subjected to a whole surface exposure.

Also, an image of the necessary copy area may be obtained by using a device comprising a large number of spot light sources such as a matrix display instead of a light source and a masking member as shown in FIGS. 12 and 14, and suitably controlling on-off of the spot light sources. In this case, it is preferable that screen plates 63 be suitably provided as shown in FIG. 14 to produce a sharp image of the edge portion. However, if a light source such as matrix display is arranged in a position proximate to the surface of the photosensitive medium, then a sufficiently sharp image of the edge portion can be obtained without provision of screen plates.

Now, the manner of operation of the masking member will be described with reference to an illustrative example thereof.

As previously described, FIG. 3B shows an image area 12' (which is referred to as document image) corresponding to a document. In FIG. 3B, the rectangle ABCE containing a portion (portion to be copied) in an irregular form represents a copy area 13. The remaining portion of the document is an unnecessary image area and 14 designates the position of copy material. The document image 12' is scanned successively in the direction of arrow every slit exposure width. A-B (D-C) is the width of the copy area 13 and A-D (B-C) is the length thereof.

FIGS. 15A through 15D show an illustrative example of operation of the masking 55 required to obtain the copy area 13 from the document image 12'. The view on the left side of each of FIGS. 15A–15D is a cross-section taken along the line V–V' through the copy area and the view on the right hand side shows the manner how the masking member 55 controls the irradiation area of the control light. In each, the view on the left hand side, solid line and dotted line extending around the photosensitive drum 23' stand for an image I to be formed from a document image as shown in FIG. 3B. With the rotation of the photosensitive medium 23' in the direction of arrow, the image I moves on the photosensitive medium. In the image I, the solid line portion corresponds to the copy area (area 13 in FIG. 3B) and the dotted line portion to the unnecessary image area. In the view at the right hand side, the area 64 enclosed by the dotted line indicates the irradiation area of the control light 53 for the image area of the document image exposed to the exposure light 57.

Figure 15A:
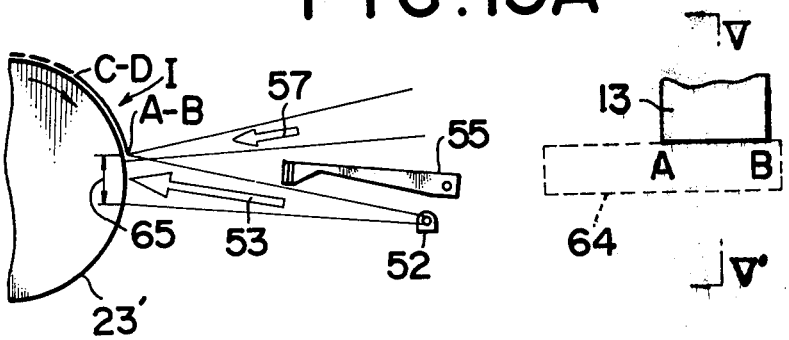
FIGS. 15A to 15D show the manner of operation of the masking member in various operational positions.
Figure 15B:
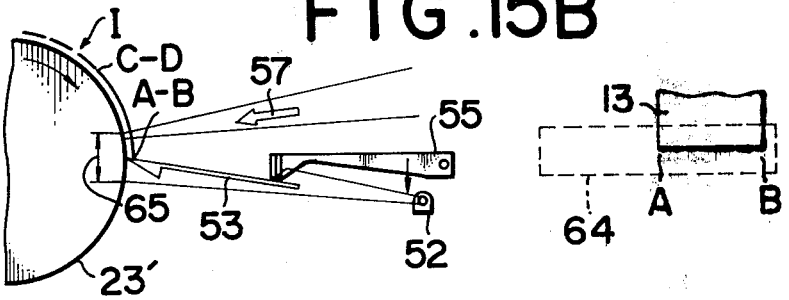

As seen in FIG. 15A, the masking member 55 remains outside the path of the control light 53 until the fore edge A-B of the copy area in the image I reaches the irradiation area 64 of the control light. Therefore, the whole irradiation area 64 on the photosensitive medium 23' is subjected to the irradiation of the control light 53 and electric charge applied to the area is erased. As a result, the whole electrostatic latent image in the area extending to the position A-B on the photosensitive medium is completely erased and in the portion corresponding to the area there is formed no image. When the position A-B of the image I is advanced and reaches the irradiation area 64, the lower end of the masking member begins moving downward in synchronism with the advance of A-B as shown in FIG. 15B. The masking member 55 continues moving downward in the direction of arrow up to the position in which the masking member cuts off the cotrol light 53 completely and then the masking member stops at the position. This position is indicated by the masking member 55' in FIG. 12. The masking member remains in the position until the rear end C-D of the copy area of image I reaches the light irradiation area 64. Therefore, irradiation of the control light 53 to the area corresponding to the masking member 55 and lying within the irradiation area 64 is hindered by the masking member and in the area the electrostatic latent image can be retained unerased. On the other hand, the remaining portion of the irradiation area 65 outside the masking member 55 is subjected to the irradiation of the control light 53 so that the electrostatic latent image in this portion is erased.

Figure 15C:
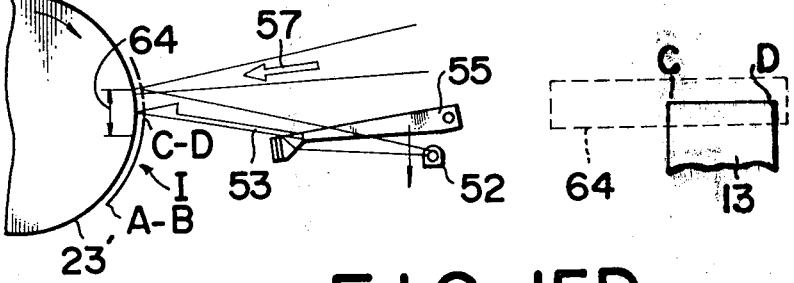

When the position C-D of image I is further advanced and reaches the irradiation area 64, the upper end of the masking member 55 begins moving downward in the direction of arrow in synchronism with the advance of C-D as shown in FIG. 15C. Finally, it comes to a position outside the path of the control light 53 and stops at the position. The masking member retains the position until the image I has passed over the irradiation area 64, that is, until the scanning of the document image has been completed. Thus, the electrostatic latent image existing in the area extending from the line C-D to the rear end of the image I is erased and therefore no image is formed in the corresponding area of the produced copy like the area extending from the fore edge of image I to the line A–B described above. In this manner, an image is formed only in the copy area 13 and a copy as shown in FIG. 3B can be obtained.

Figure 15D:
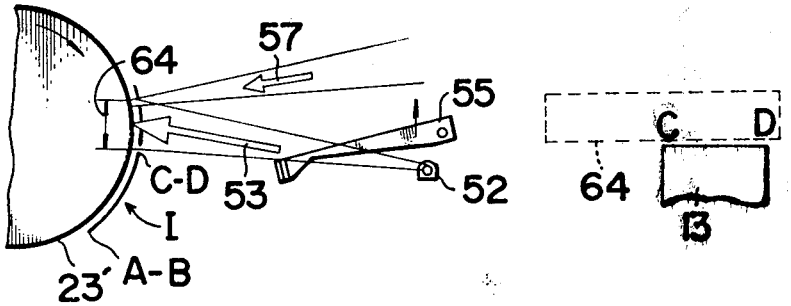

Upon the completion of the scanning of the document image, the masking member 55 begins moving upward in the direction of arrow as shown in FIG. 15D and returns back to the starting position shown in FIG. 15A.

The manner of operation of the masking member 55 for obtaining the necessary image according to the invention has been described with reference to an illustrative embodiment thereof. From the foregoing it will be understood clearly that the present invention enables to produce a faithful copy of the copy area 13 of the document image 12' in which unnecessary portion of the document image 12' is omitted exactly and the edge portion of the copied image is very clear and sharp.

It is not always necessary to move the masking member 55 downward exactly in timing with the advance speed of the electrostatic latent image projected on the photosensitive medium. For example, the masking member 55 can be moved at a high speed that that of the advance speed of the latent image so long as a momentary synchronism of the masking member with the fore edge A-B of image I is attained. In this case, the unnecessary electric charge may be sufficiently erased by increasing the intensity of irradiation of the control light 53 accordingly.

Since the copy area is defined by the X-indicator 8 and XR-indicator 10 as shown in FIGS. 3A and 6 as far as X direction concerns, the above described operation of the masking member 55 may be realized by bringing the control means for masking member into operation while correlating it with the operation of the scanning system.

More particularly, the masking member is controlled in the following manner:

In each copying cycle, the scanning system is started from the home position (position of H1) determined by the X-indicator 8 and when it begins scanning of the copy area 13 there is produced a scanning start signal from the start position detector H2. Responding to the signal, driving means such as motor MX drives the masking member into rotation and stops it after a certain angle of rotation. This is the step during which the masking member comes to the position 55' shown in FIG. 12 starting from the time point when the position A-B of image I in FIG. 15A has just reached the control light irradiation area 64.

In the next step, when the scanning system arrives at the position of the detector H3 of XR-indicator 10, there is produced a signal informing of the completion of scanning the copy area 13. In response to the signal, the masking member is moved again and after a certain angle of rotation it is stopped. At the completion of scanning the whole image area corresponding to the size of copy material then used, the masking member 55 is returned back to its starting position. This step corresponds to the phase shown in FIG. 15C (arrival of C-D of image I at the irradiation area 64) to FIG. 15D (the return of masking member 55 to its original position).

As far as the Y direction is concerned, the copy area is defined by Y-indicator 9 and YR-indicator 11. Therefore, the necessary control may be realized by controlling the base position for image on the photosensitive medium interlockingly with the motion of Y-indicator and controlling the range of copy area by YR-indicator.

As seen in FIG. 6, the length of copy area measured in Y direction corresponds to the distance between Y-indicator 9 and YR-indicator 11. Signals informing of the positions of Y-indicator 9 and YR-indicator 11 can be detected as changes of voltage or resistance relative to the base point 7 using suitable measuring means such as potentiometers PMY and PMYR shown in FIG. 6. These signal are converted into digital signals by A-D converter ADY and then subtracted from the reference values respectively. These digital signals thus obtained are introduced into a motor control circuit MCY to actuate the pulse motor MY. As a result, the mask element 55-2 of the masking member is moved in the direction of arrow to a certain predetermined position by the pulse motor MY. In this manner, the effective width of the masking member 55 is determined with which the control area by the control light is determined depdnding upon the position of YR-indicator 11.

The control of the width of masking member may be carried out also by connecting the masking member with the indicator using a wire and pulley in a similar manner to that shown in FIG. 11 for control of the lens moved. On the contrary, the control system using a pulse motor shown in FIG. 6 may be applied for controlling the shift of lens shown in FIG. 11.

The copying machine has been described in detail in which a copy area is preset using base line indicator and range indicator and then the end of copy material is aligned with the end of the copy area preset on the original placement surface by the base line according to the invention. However, it should be understood that the present invention is never limited only to the above described copying technique. According to the principle of the invention, it is also possible to realize such type of copying machine in which the original base line remains always fixed at the base position 7X-7Y shown in FIG. 3A as in the case of conventional copying machine and a copy area is defined by four indicators in total, one pair for X direction and another pair for Y direction using X-indicator 8 and Y-indicator 9 in FIG. 3A also as range indicators.

For this modification, since the position of document image of copy material is not shifted but remains fixed, it is required to erase the image existing in the area between the base line 7X and the line B–C which is one end line of the copy area defined by the Y-indicator 9. Therefore, another mask element 55-1 (see FIGS. 13 and 14) also has to be slide movably mounted like the mask element 55-2, and a lamp functionally corresponding to the above described lamp 52-R must be provided.

As for X direction, the image existing in the area between the base line 7Y and the fore edge line A–B of the copy area 13 may be erased by controlling the movement of the masking member in such manner that the photosensitive medium is subjected to the irradiation of the control light 53 until the fore edge A-B of image I in FIG. 15A is exposed to imagewise exposure light.

While the invention has been particularly shown and described with reference to preferred embodiment thereof, it will be understood by those skilled in the art that the foregoing and other changes in form and details can be made therein without departing from the spirit and scope of the invention. For example, while all of the indicators have been shown to be provided slide movably on the original table, they may be provided on a mounting mechanism additionally provided for monitoring the original so as to assure a more easy and accurate setting of original base line or copy area.

We claim:

1. A copying machine capable of setting an original reference line which defines an area to be copied for a document placed at any position on the original placement surface of the machine, said copying machine comprising:

an original table having an original placement surface on which a document is placed;

optical means including a lens for projecting an image of the document placed on said original placemnt surface;

means for visualizing the image;

means for determining an original reference line on said original placement surface; and means for controlling the feeding of copy material in response to a signal from said determining means.

2. A copying machine capable of setting an original reference line which defines an area to be copied for a document placed at any position on the original placement surface of the machine, said copying machine comprising:

an original table having an original placement surface on which a document is placed;

optical means including a lens for projecting an image of said document placed on said original placement surface;

means for visualizing said image;

means for determining an original reference line on the original placement surface, wherein said reference determining means comprises a movable reference indicator for setting an original reference line; and means for controlling the position of the optical lens in such a manner that, depending upon the amount of movement of said indicator, said optical lens may be shifted in the same direction as the movement of said indicator and normal to the optical axis of said lens by a predetermined distance.

3. A copying machine capable of selectively setting an area to be copied for a document placed on the original placement surface of the machine, said copying machine comprising:

an original table having an original placement surface on which a document is placed;

optical means including a lens for projecting the image of the document placed on said original placement surface onto a photosensitive member;

means for visualizing the image on said photosensitive member;

means for determining the copy area of the document;

a light source for irradiating said photosensitive member with light during the formation of an electrostatic latent image between initial charging to development in order to control the area in which the latent image is formed;

an opaque means for screening the light from said light source to prevent it from irradiating said photosensitive member;

means for controlling the width of light irradiation measured in the direction normal to the moving direction of said photosensitive member in accordance with the position of said copy area determining means; and means for causing said masking means to move across the light path from said light source in relation to movement of said photosensitive member in accordance with the position of said determining means so as to control the forming length of the latent image in the direction of said photosensitive member.

4. A copy machine as claimed in claim 1, further comprising a scanning system for scanning the document and directing an image thereof to said lens, wherein said reference determining means comprises a reference indicator provided movably to set an original reference line and means interlocked with said indicator to detect the amount of movement of the scanning system.

5. A copying machine as claimed in claim 1, wherein said reference determining means comprises a reference indicator provided movably to set an original reference line and said control means controls the position of the optical lens in such manner that depending upon the amount of movement of said indicator, said optical lens may be shifted in the same direction as that of movement of said indicator and normal to the optical axis of said lens by a certain predetermined distance.

6. A copying machine as claimed in claim 1, wherein said reference determining means comprises a plural number of reference indicators.

7. A copying machine as claimed in claim 4, wherein said detecting means has a home position detecting portion for temporarily stopping the scanning system and a scanning start detecting portion for producing a signal informing of the start of scanning.

8. A copying machine as claimed in claim 5 or 2, wherein said reference indicator is connected with the lens through a driving power transmission means.

9. A copying machine as claimed in claim 5 or 2, wherein said control means detects electrically the amount of movement of said reference indicator and moves the lens through a driving source by a distance in proportion to the detected amount of movement.

10. A copying machine as claimed in claim 1, wherein said copying machine further comprises:

means for determining the range of area to be copied of a document placed on the original placement surface;

a photosensitive member on which the image is formed as an electrostatic latent image;

a light source for irradiating said photosensitive member with light during the formation of the electrostatic latent image between an initial charging and development in order to control the area in which said latent image is formed;

masking means for screening the light from said light source to prevent it from irradiating said photosensitive member;

means for controlling the width of light irradiation measured in the direction normal to the moving direction of said photosensitive member in accordance with the position of said determining means; and means for causing said masking means to move across the light path from said light source in relation to movement of said photosensitive member in accordance with the position of said determining means so as to control the forming length of said photosensitive member.

11. A copying machine as claimed in claim 10 or 3, wherein said controlling means controls the width of said masking means.

12. A copying machine as claimed in claim 11, wherein said light source is composed of a plural number of spot light sources and screen plates are provided at selected positions between the spot light sources to prevent interference of light with each other.

13. A copying machine as claimed in claim 11, wherein said light source is a whole surface exposure lamp which illuminates the whole surface of a three layered photosensitive member including a conductive layer, a photoconductive layer and an insulating surface layer to form an electrostatic latent image after said photosensitive member is primarily charged to a predetermined polarity, and then discharged or charged to the opposite polarity simultaneously with an imagewise exposure thereof.

* * * * *

UNITED STATES PATENT AND TRADEMARK OFFICE

CERTIFICATE OF CORRECTION

PATENT NO. : 4,256,400

DATED : March 17, 1981

INVENTOR(S) : SHIGEHIRO KOMORI, ET AL.

It is certified that error appears in the above-identified patent and that said Letters Patent are hereby corrected as shown below:

Column 1, line 55, delete "which";

Column 2, line 42, "allow" should read --allows--;

Column 3, line 60, delete "wished";

Column 5, line 42, "pushd" should read --pushed--;

Column 10, line 31, "baselline" should read --base line--;

Column 12, line 49, "cotrol" should read --control--;

Column 13, line 29, "high" should read --higher--;
"That that" should read --Than that--;

Column 14, line 14, "signal" should read --signals--;
line 23, "depdnding" should read --depending--;

UNITED STATES PATENT AND TRADEMARK OFFICE

CERTIFICATE OF CORRECTION

PATENT NO. : 4,256,400

DATED : March 17, 1981

INVENTOR(S) : SHIGEHIRO KOMORI, ET AL.

It is certified that error appears in the above-identified patent and that said Letters Patent are hereby corrected as shown below:

Column 15, line 5, "mounting" should read --monitoring--.

Signed and Sealed this

*Eleventh* Day of *August 1981*

[SEAL]

*Attest:*

GERALD J. MOSSINGHOFF

*Attesting Officer*

*Commissioner of Patents and Trademarks*